United States Patent [19]

Rudolph et al.

[11] Patent Number: 4,914,278

[45] Date of Patent: Apr. 3, 1990

[54] INTERNALLY ILLUMINATED RESET COUNTER

[75] Inventors: Achim J. Rudolph, Glastonbury; Arnold C. Johnson, West Hartford, both of Conn.

[73] Assignee: Western Pacific Industries Inc., New York, N.Y.

[21] Appl. No.: 355,986

[22] Filed: May 22, 1989

[51] Int. Cl.[4] ..... G06C 5/02

[52] U.S. Cl. ..... 235/10; 235/1 C; 235/117 R; 235/139 R; 235/144 R; 235/144 SP; 235/144 TP

[58] Field of Search ..... 235/1 C, 1 D, 109, 110, 235/135, 139 R, 140, 142, 144 PN, 144 SM, 144 SP, 144 MG, 144 TP, 144 R, 117 R

[56] References Cited

U.S. PATENT DOCUMENTS

| | | | |
|---|---|---|---|
| 2,737,345 | 3/1956 | Harada | 235/1 C X |
| 3,138,323 | 6/1964 | Yolin | 235/1 C X |
| 4,314,149 | 2/1982 | Gomez | 235/139 R X |
| 4,774,398 | 9/1988 | Rudolph et al. | 235/1 D |
| 4,829,164 | 5/1989 | Rudolph et al. | 235/139 R |

*Primary Examiner*—Benjamin R. Fuller

*Attorney, Agent, or Firm*—Chilton, Alix & Van Kirk

[57] ABSTRACT

An internally illuminated reset counter employs a shaft and counter wheel portions which are manufactured from light transmissive materials. A series of axially spaced grooves in the shaft function to direct light through the counter wheels and axially balance the light intensity.

19 Claims, 4 Drawing Sheets

INTERNALLY ILLUMINATED RESET COUNTER

BACKGROUND OF THE INVENTION

This invention relates to counters which employ rotatable counter wheels. More particularly, the present invention relates to new and improved reset counters of highly efficient, inexpensive construction.

Counters which employ rotatable wheels having consecutive numerals on the outer rims of the wheels are well known. Such counters typically employ several counting wheels having consecutive numerals on their outer peripheral surfaces and transfer pinions between adjacent wheels for rotatably advancing the count of the succeeding number wheel in response to the rotatable advancement of the lower order wheel. Reset counters to which the invention relates, such as trip odometers installed in vehicles, typically employ a reset finger assembly. Manual actuation of a reset lever forces fingers into engagement with cam surfaces of the counter wheels for returning the counter wheels to the zero position. The finger assembly typically is coordinated with the transfer pinion assembly so that the transfer pinions are withdrawn from engagement with the counter wheels to allow for the resetting.

In U.S. Pat. No. 4,774,398, assigned to the assignee of the present invention, a low-cost non-resettable counter employs an axially extending barrel which forms a segmental cylindrical surface. The barrel which typically has a diameter significantly greater than a conventional counter wheel mounting shaft receives counter wheels in axial side-by-side disposition to form a bank of co-axial rotatable counter wheels. The barrel additionally defines an axial groove which is recessed from the cylindrical mounting surface. A pinion shaft integrally extends from an end wall of the groove and axially traverses the groove for mounting the transfer pinions. The transfer pinions continuously engage between the adjacent counter wheels for rotatably advancing a high order wheel in response to a pre-established angular rotation of the lower order wheel.

U.S. Pat. No. 4,829,164 filed on July 18, 1988, and assigned to the assignee of the present invention, discloses a low cost counter barrel which is manufactured from transparent or translucent material. The barrel and the counter wheels may be constructed of light transmissive materials and arranged to provide an internal light path to illuminate the counter in an efficient and esthetically pleasing manner. The foregoing counter disclosed in U.S. Pat. application No. 4,829,164 does not have any dividing structures centrally of the barrel which would tend to interrupt the light path. The internal light path is also not constrained or interrupted by variably positionable pawl mechanisms or significant axial spacing between adjacent counter wheels such as may be present for resetting the counter wheels in low cost resettable counters.

SUMMARY OF THE INVENTION

Briefly stated, the invention in a preferred form is an internally illuminated reset counter which is especially adapted to provide for internal illumination through the outer peripheral indicia rims of the counter wheels. In one embodiment, the illuminated reset counter comprises a plurality of substantially identical counter wheels which comprise a central portion manufactured from light transmissive material integrally forming an outer indicia rim. Axially spaced portions of the counter wheels are formed of generally opaque materials. An axially extending shaft composed of light transmissive material mounts the counter wheels to form a bank of co-axial rotatable counter wheels of increasing order. The shaft functions as an optical cable and is configured to provide a series of axially spaced light distributing structures for directing light generally radially from the shaft. A light source in optical communication with the shaft is directed axially along the shaft and generally radially through the indicia rim to highlight the indicia.

In one embodiment, the shaft has a plurality of axially spaced circumferential grooves which generally align with the central portion of the mounted counter wheels. The grooves are dimensioned in accordance with the relative order of the counter wheels so that the light is generally uniformly distributed for transmission through the counter wheels. One or more grooves may be provided for each counter wheel. In one form of the invention, the counter wheels have a three-piece snap assembly-type construction.

An object of the invention is to provide a new and improved illuminated reset counter of efficient and low-cost construction.

Another object of the invention is to provide a new and improved reset counter which can be efficiently adapted for operation in connection with an external light source to provide for internal illumination in an aesthetically pleasing manner.

A further object of the invention is to provide a new and improved internally illuminated reset counter which may be assembled in an efficient manner especially adaptable for automated assembling techniques.

Other objects and advantages of the invention will become apparent from the drawings and the specification.

DETAILED DESCRIPTION OF THE INVENTION

Figure 1:
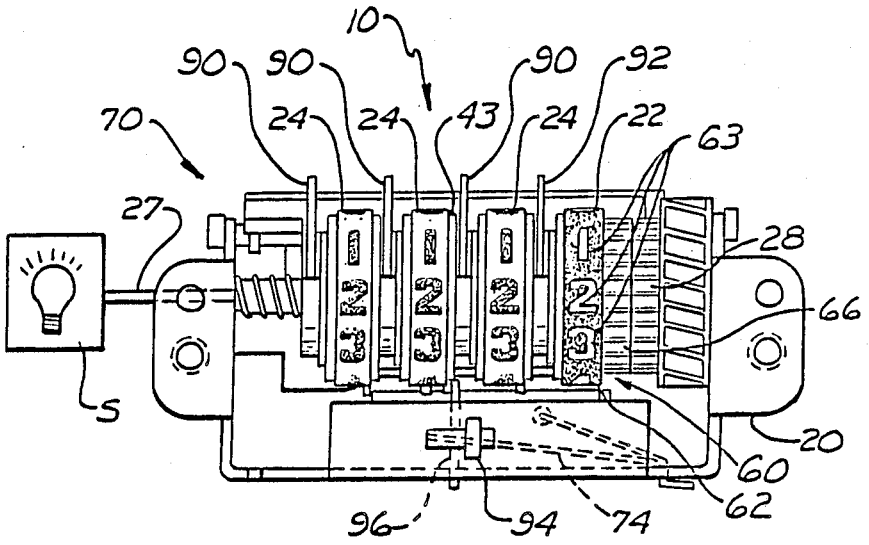
FIG. 1 is a top view, partly in schematic and partly in phantom, of an internally illuminated reset counter in accordance with the present invention.
Figure 2:
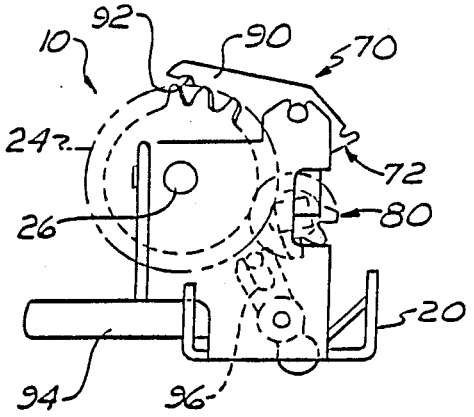
FIG. 2 is a cross-sectional view, partly in phantom, of the reset counter of FIG. 1.

With reference to the drawings wherein like numerals represent like parts throughout the figures, an internally illuminated reset counter in accordance with the present invention is generally designated by the numeral 10 in FIGS. 1 and 2. Reset counter 10 may be any of a number of models, styles, and configurations and may, for example, take the form of a trip odometer employed in vehicles. The specific reset counter 10 is illustrated for purposes of describing the invention and should not be deemed a limitation of the invention which is also applicable to non-reset counters. The invention generally is directed to providing internal illumination in a counter of a type wherein counter wheels are mounted on a shaft and axial spacing between the counter wheels is required to accommodate a finger or reset mechanism for resetting the counter to the zero position.

With reference to FIGS. 1 and 2, the reset counter 10 comprises a frame 20. The frame 20 provides the principal mounting and support structure for the counter. The frame 20 may assume a wide variety of configurations in accordance with the specific application. A housing or cover (not illustrated) may be mounted over the frame to form a window for viewing the counting. A lowest order counter wheel 22 and three substantially identical high order wheels 24 are rotatably mounted in the frame to form a bank of counter wheels of ascending order (from right to left). The counter wheels are mounted to a shaft 26 which is mounted at opposing axial ends through apertures of the frame 20 or by other conventional means. The shaft integrally connects with a drive gear 28 of axial bifurcated form which functions to drive the counter. The shaft 26 and the drive gear 28 may be separate components. Naturally, the counter may employ any number of counter wheels according to the specific application.

Figure 5:
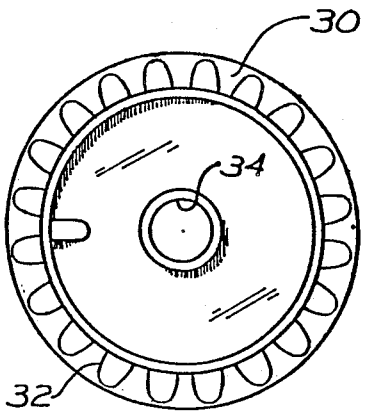
FIG. 5 is a side elevational view of the counter wheel of FIG. 3 viewed from the right thereof.
Figure 3:
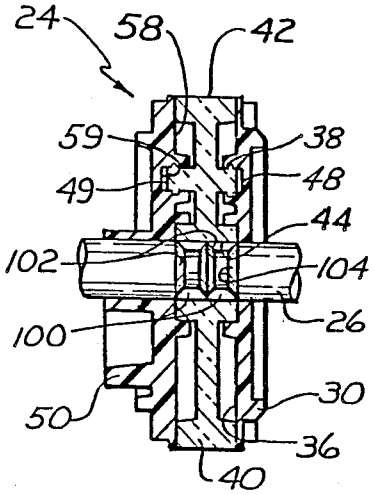
FIG. 3 is an enlarged fragmentary sectional view of a counter wheel and shaft employed in the reset counter of FIG. 1.
Figure 4:
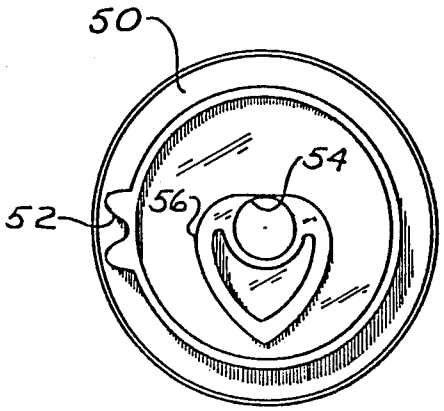
FIG. 4 is a side elevational view of the counter wheel of FIG. 3 viewed from the left thereof.

With additional reference to FIGS. 3 through 5, each of the high order counter wheels 24 are substantially identical wheel assemblies comprising a low order panel 30, a central medial element 40 and a high order panel 50. Components 30, 40 and 50 are preferably plastic molded components which snap together to form the assembled high order wheel 24. Low order panel 30 and high order panel 50 are manufactured from opaque materials. Medial element 40 is manufactured from a clear light transmissive material.

On the low order side of each low order panel 30, is an integrally formed radially recessed, involuted driven gear 32 having twenty teeth. Naturally, other numbers of teeth are also possible. The low order panel 30 also forms an integral hub defining a central aperture 34 which is approximately commensurate in diameter with the diameter of shaft 26 for rotatably mounting the wheel to the shaft.

On the high order end of each high order panel 50, is an integrally formed two-tooth driving gear 52 which extends radially inward from the outer periphery. The high order panel also forms an integral hub defining an aperture 54 which is approximately commensurate in diameter with shaft 26 for rotatably mounting the counter wheel assembly to the shaft. In addition, a cardioid cam surface 56 extends axially from the higher order side of the high order panel 50 to form a cam surface surrounding aperture 54 for resetting the counter wheel.

The medial component 40 comprises an outer peripheral rim 42 having suitable readout indicia 43, such as the consecutive numerals from 0 to 9. Medial component 40 is preferably manufactured from clear plastic material. The indicia 43 may be hot stamped or lithographed onto the rim 42. The medial panel 40 forms a central cylindrical aperture 44 which ordinarily is slightly greater than the diameter of shaft 26 to form an annular light cavity about the shaft. Pins 48 and 49 integrally extend axially for close fitting reception by complementary recesses 38 and 59 in panels 30 and 50, respectively. The pins 48 and 49 may include diametral projections which snap into complementary grooves. In addition, panels 30 and 50 have outer flat surfaces 36 and 58 which closely receive the high and low order axial edges of the peripheral rim 42 so that the components 30, 40 and 50 may be snapped together in an efficient, close fitting relationship to form the assembled high order counter wheel 24.

The lowest order counter wheel 22 may be substantially identical to a high order counter wheel 24, except for the low order panel 60 and the color scheme of the indicia rim 62 and the indicia 63. The low order panel may comprise a well defined driven gear 66 which extends axially to a greater extent than that of the driven gears of the high order wheels. The driven gear 66 thus has a greater area of engagement with the drive pinion (not illustrated) which meshes between drive gear 28 and driven gear 66.

A reset assembly designated generally by the numeral 70 is pivotally mounted through apertures at the upper rear of the frame. The assembly 70 comprises a reset finger 72 biased by spring 74. The reset sub-assembly carries coaxially mounted transfer pinions 80 as well as the co-axial drive pinion. The transfer pinions 80 are engagable between driving gears 52 and driven gears 32 of adjacent counter wheels for transferring the count from a lower order wheel to a higher order wheel. The transfer pinions of conventional form have alternating full and mutilated teeth (not illustrated) for providing the appropriate count transfer within the bank of counter wheels. In a preferred embodiment, there are four full teeth and four mutilated teeth. A full drive pinion (not illustrated) engages between the drive gear 28 and the driven gear 66 of the lowest order counter wheel. During the counting mode, the transfer pinions 80 and the drive pinion continuously engage with the counter wheels to provide the counting function.

Axially spaced reset fingers 90 project from the upper rear of the reset sub-assembly in general alignment with the high order ends of the counter wheels. The fingers each include a contoured surface. The finger surfaces 92 are angularly positionable for engagement with the cam surfaces 56 of the counter wheels to force the wheels to rotate to the zero position. Adjacent end portions of the counter wheels are axially spaced to accommodate the coordinated finger movement between the counter wheels for finger engagement with the cam surfaces 56. A vertically displaceable reset lever 94 connects via linkage 96 for angularly pivoting the reset sub-assembly against the bias of the spring 74. The counter may thus be reset by depressing the reset lever 94, thereby simultaneously withdrawing the pinions from engagement with the driven and the driver gears and forcing the reset fingers into engagement with the wheel cam surfaces to return the counter wheels to the zero position. The reset sub-assembly is spring biased so that the fingers 90 are normally biased out of engagement with the cam surfaces 56 and the transfer pinions engage the counter wheels to implement the counting function.

With reference to FIG. 1, internal illumination of the counter is provided by introducing a light source S via a suitable optic cable 27 to shaft 26. Alternatively, a light source may be introduced directly at the end of shaft 26. Shaft 26 is manufactured from a molded clear plastic material which is highly light transmissive. The shaft 26 functions as an optical cable. The light is distributed and balanced by means of circumferential refracting grooves 100 which are molded into the shaft. One or more grooves may be associated with a given counter wheel. The groove or groove groups align with corresponding counter wheels and are dimensioned in accordance with the distance of the corresponding counter wheel (or the order of the wheel) from the introduction of the light source into the shaft.

Figure 6:
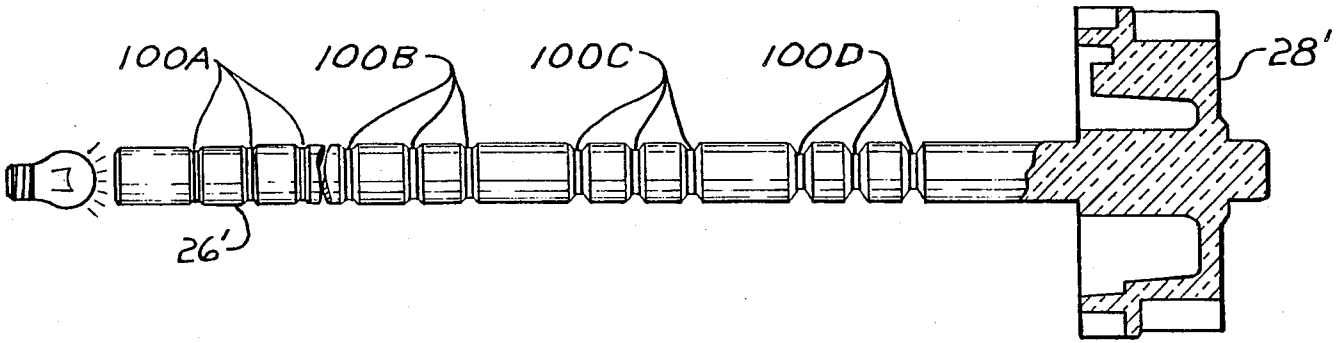
FIG. 6 is an enlarged sectional view, partly broken away, of a shaft and drive assembly employed in an internally illuminated reset counter in accordance with the present invention.

The grooves 100 (FIG. 3) are defined by opposing refracting surfaces 102 and 104 which are oriented at an angle to the shaft (45° in the drawings — other angles may also be suitable). For a given groove 100, the depth and width may be substantially uniform throughout the groove although not required in all embodiments. The depths and widths of the grooves differ in accordance with the associated counter wheel position. An alternate embodiment of a shaft 26, and integral drive gear 28' of FIG. 6 illustrates the groove variations for a four wheel counter having three refracting grooves for each wheel. Substantially identical grooves 100D for the lowest order counter wheel, substantially identical grooves 100C of the next higher order wheel, substantially identical grooves 100B of the higher order wheel, and substantially identical grooves 100A for the highest order wheel are molded into the shaft 26'. Grooves 100A, 100B, 100C and 100D have progressively larger depths and widths as the corresponding counter wheel distance from the light source increases.

The depths for the grooves of one embodiment having an axial counter wheel spacing of 0.400 inches (axial wheel center to axial wheel center) and shaft 26 of 0.187 inches diameter is set forth in Table I.

TABLE I

| Grooves | Depth |
|---|---|
| 100A | 0.0150 in. |
| 100B | 0.0175 in. |
| 100C | 0.0200 in. |
| 100D | 0.0225 in. |

By suitably selectively dimensioning the grooves, relatively less light will be radially directed at the proximal regions where the light is most intense and relatively more light will be radially directed at the remote ends so that the light which passes through the light transmissive medial panels will be substantially balanced across the counter. The groove defining surfaces function to interrupt the axial light path traversing the shaft and to refract the light generally radially. The groove defining surfaces also cause some internal reflection within the shaft which reflection interrupts the axial light transmission at the location of the light transmissive medial panels 40. The light path will thus traverse through the medial panel and through the indicia rim for highlighting the indicia due to the internal counter illumination.

It should be appreciated that the opaque panels 30 and 50 function to limit radial dispersion of the light which is generally conducted axially through the shaft and to further direct the light radially through the peripheral indicia rims. The dimensioning of the grooves is directly related to the specific shaft end location of the introduction of the input light. For example, the dimensioning relationship would be reversed if the light source were to be introduced at the opposing end of the shaft. A light source could be introduced at both ends of the shaft or other location of the shaft in which case the dimensioning of the grooves for a given wheel would be related to the distance of the wheel from the light source.

For most applications, the diameter of the counter shaft 26 will be somewhat greater than similar conventional counter shafts because the presence of grooves may result in a weakening of a shaft of a given diameter — all other factors being equal.

The indicia rims may be hot stamped in white or any other colors. Ordinarily, distinctive color schemes are employed on the lowest order or the tenths counter wheel for odometer applications. In preferred form, the wheel assemblies are cast as separate three-piece components and assembled.

Figure 7:
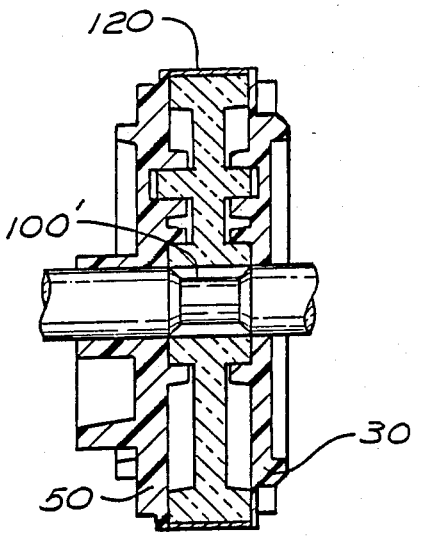
FIG. 7 is an enlarged fragmentary sectional view of an alternate embodiment of a counter wheel assembly and shaft for the reset counter of FIG. 1.

With reference to FIG. 7, a white ring 120 (other colors are also suitable) may be wrapped around the medial panel 40' to form the outer indicia rim defined by the black background outlining the translucent or transparent numerals. A single light directing groove 100' is employed for a given counter wheel. The diametral opening of the aperture 44' of the medial panel may also be increased to enhance the light transmission.

Figure 8:
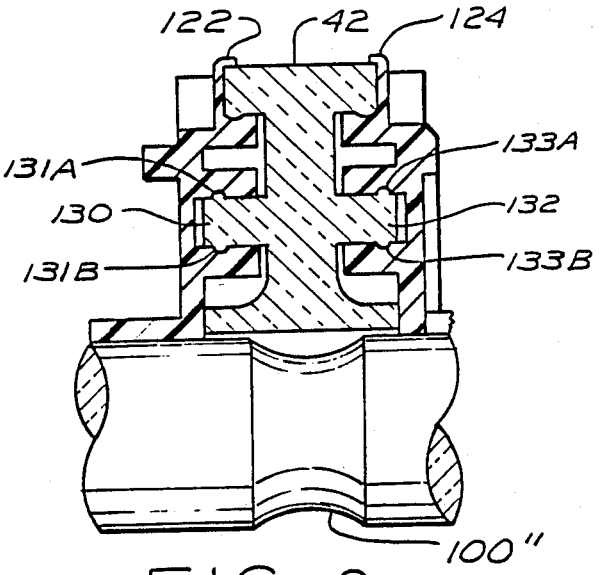
FIG. 8 is an enlarged fragmentary sectional view of a second alternate embodiment of a counter wheel assembly and shaft for the reset counter of FIG. 1.

Flanges 122 and 124 on the high order and low order panels as illustrated in FIG. 8 function to prevent light leakage. The flanges 122 and 124 extend axially to engage the indicia rim 42. The light distribution groove 100'' is contoured so as to have an arcuate section. Pin 130 has diametral projections 131A and 131B which snap into corresponding recesses of the high order panel. Pin 132 has diametral projections 133A and 133B which snap into corresponding recesses of the low order panel.

It should be noted that the foregoing reset counter 10 incorporates a very efficient internal illumination system which effectively limits radiation loss through the counter components in a very efficient manner, even though the wheels are not closely spaced, but have a slotted spacing so as to allow for resetting of the wheels.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An internally illuminatable reset counter comprising:

a plurality of counter wheels adapted to be rotatably driven, each of said counter wheels comprising a medial portion comprised of light transmissive material, an outer indicia rim and axially spaced portions of generally opaque material;

assembly means comprising an axially extending shaft for mounting said counter wheels to form a bank of co-axial rotatable counter wheels of increasing order, said shaft being formed of light transmissive material and comprising a series of axially spaced light distributing means for directing light generally radially from said shaft;

transfer means for rotatably advancing a higher order wheel in response to a pre-established angular rotation of a lower order wheel; and reset means for angularly rotatably resetting said counter wheels to a pre-established reference position, so that a light source in optical communication with said shaft optically communicates axially along said shaft and generally radially through said indicia rim to highlight said indicia.

2. The counter of claim 1 wherein each said counter wheel is formed from three molded components which are assembled in a snap-fit type construction.

3. The counter wheel of claim 1 wherein each said counter wheel is formed from four molded components.

4. The counter of claim 1 wherein said central portion defines a central aperture defining a light conducting cavity surrounding said shaft.

5. The counter of claim 1 wherein said light distributing means comprises grooves at axially spaced positions in said shaft.

6. The counter of claim 5 wherein said grooves have depths that vary in accordance with the axial position of said grooves.

7. The counter of claim 6 wherein the shaft has an optical input end and the wheels are each located at a corresponding axial distance from said input end and the depths of the grooves vary in accordance with the axial distance of the associated counter wheel from the input end of said shaft.

8. The counter of claim 7 further comprising light means for applying light at said input end of said shaft, the depths of the grooves for a given counter wheel increasing in accordance with the distance of the wheel from the input end.

9. An internally illuminatable counter comprising:

a plurality of counter wheels adapted to be rotatably driven, each of said counter wheels comprising a three component molded construction, including a medial portion comprised of light transmissive material and forming an outer indicia rim and axially spaced portions comprised of generally opaque material;

assembly means comprising an axially extending shaft for mounting said counter wheels to form a bank of coaxial rotatable counter wheels of increasing order, said shaft being formed of light transmissive material and comprising a series of axially spaced light distributing means for directing light generally radially from said shaft through said medial portions;

transfer means for rotatably advancing a high order wheel in response to a pre-established angular rotation of a low order wheel, so that a light source in optical communication with said shaft forms a light path extending axially along said shaft and generally radially through the indicia rim to highlight said indicia.

10. The counter of claim 9 wherein said light distributing means comprise means defining a series of axially spaced grooves in said shaft.

11. The counter of claim 10 wherein each groove has an associated depth and the depths of said grooves vary in accordance with the order of said associated counter wheel.

12. The counter of claim 9 wherein said shaft defines a longitudinal axis therethrough and said light distributing means further comprise pairs of opposed refracting surfaces oriented at an acute angle relative to the longitudinal axis of the shaft.

13. The counter of claim 9 wherein said light distributing means further comprises an annular arcuate section.

14. An internally illuminable reset counter comprising:

a plurality of counter wheels adapted to be rotatably driven, said counter wheels comprising mounting means for mounting said wheels, an outer indicia rim and means defining a light path through said indicia rim of light transmissive material;

assembly means comprising an axially extending shaft for mounting said counter wheels to form a bank of co-axial rotatable counter wheels of increasing order, said shaft being formed of light transmissive material and comprising means defining a series of axially spaced light distributing grooves generally alignable with said counter wheels;

transfer means for rotatably advancing a higher order wheel in response to a pre-established angular rotation of a lower order wheel; and reset means for angularly rotatably resetting said counter wheels to a pre-established reference position, so that a light source in optical communication with said shaft optically communicates along said shaft and through said indicia rim to highlight said indicia.

15. The counter of claim 14 wherein said light source is optically communicable to form a light dispersion from said shaft and further comprising opaque means for limiting the dispersion of light between said counter wheels.

16. The counter of claim 15 wherein said opaque means comprises a panel-like counter wheel portions composed of opaque material.

17. The counter of claim 14 wherein the grooves are progressively dimensioned in accordance with the order of the associated counter wheel.

18. The counter of claim 14 wherein at least one groove is associated with each counter wheel.

19. The counter of claim 14 wherein said counter wheels further comprise flange means engaging portions of said indicia rims for preventing optical communication of light between said indicia rims.

* * * * *